US007009168B2

(12) United States Patent
Matsuyama et al.

(10) Patent No.: US 7,009,168 B2
(45) Date of Patent: Mar. 7, 2006

(54) SENSOR

(75) Inventors: Toshiyasu Matsuyama, Ohtsu (JP); Kiyofumi Fukuda, Ohtsu (JP); Yasuhiro Takada, Ohtsu (JP)

(73) Assignee: Optex Co., Ltd., Shiga (JP)

( * ) Notice: Subject to any disclaimer, the term of this patent is extended or adjusted under 35 U.S.C. 154(b) by 261 days.

(21) Appl. No.: 10/714,603

(22) Filed: Nov. 18, 2003

(65) Prior Publication Data

US 2004/0169130 A1 Sep. 2, 2004

(30) Foreign Application Priority Data

Nov. 18, 2002 (JP) ..... 2002-333705

(51) Int. Cl.
*G08B 13/18* (2006.01)

(52) U.S. Cl. ..... 250/221; 340/555

(58) Field of Classification Search ..... 250/221, 250/222.1, 338.1, 353, DIG. 1; 340/541, 340/555–557

See application file for complete search history.

(56) References Cited

U.S. PATENT DOCUMENTS

| | | | | |
|---|---|---|---|---|
| 3,958,118 | A * | 5/1976 | Schwarz | 250/221 |
| 4,263,585 | A * | 4/1981 | Schaefer | 340/567 |
| 4,429,224 | A * | 1/1984 | Wagli et al. | 250/342 |
| 4,609,266 | A * | 9/1986 | Blom | 359/851 |
| 4,636,046 | A * | 1/1987 | Blom | 359/851 |
| 4,717,821 | A * | 1/1988 | Messiou | 250/221 |
| 4,760,381 | A * | 7/1988 | Haag | 340/556 |
| 4,912,331 | A * | 3/1990 | Owers | 250/353 |
| 5,296,707 | A * | 3/1994 | Nozu | 250/353 |
| 6,211,522 | B1 * | 4/2001 | Kotlicki et al. | 250/353 |

* cited by examiner

*Primary Examiner*—Stephone B. Allen
(74) *Attorney, Agent, or Firm*—Wenderoth, Lind & Ponack, L.L.P.

(57) ABSTRACT

Sensor(s) may be such that light-projecting component(s), at which light is irradiated from one or more light-projecting elements by way of lens group(s); and light-receiving component(s), at which at least a portion of light irradiated from such light-projecting component(s) is incident on one or more light-receiving elements by way of lens group(s) after having been reflected, are arrayed therein. Lens group(s) is/are divided into a plurality of lens sets comprising a plurality of lenses. A plurality of lens sets are arranged so as to be inclined in V-shaped fashion such that a plurality of lenses occupy respectively symmetric locations.

8 Claims, 10 Drawing Sheets

SENSOR

BACKGROUND OF INVENTION

This Nonprovisional application claims priority under 35 U.S.C. § 119(a) on patent Application No. 2002-333705 filed in Japan on Nov. 18, 2002, the entire contents of which are hereby incorporated by reference.

The present invention pertains to a sensor, and in particular to an automatic door sensor.

Conventional automatic door sensors (hereinafter "sensors") detect a person or other object headed toward an automatic door and cause the automatic door to open and/or close.

Conventional sensors include, for example, sensors such as that shown in FIG. 13, in which this sensor 1 is disposed above an automatic door D, protected zone(s) intended for detection being irradiated with light from light-projecting element(s) (not shown), this irradiated light being reflected at protected zones A (A11, A12, A13, A14) and being incident on and received by light-receiving element(s) (not shown), with presence and/or absence of object(s) being detected based on the amount of light received.

Now, given protected zone(s) A11 proximate to sensor 1 and protected zones A12, A13, A14 distant from sensor 1 (in direction(s) Y), it so happens when this sensor 1 is used to detect presence and/or absence of object(s) that the characteristics of light cause zone extent to increase as one goes from protected zone(s) A11 proximate to sensor 1 to protected zones A12, A13, A14 distant from sensor 1 (in direction(s) Y). This being the case, it may sometimes happen, as shown in FIG. 13, given a plurality of protected zones A alongside automatic door D, that zone(s) A19, at which detection cannot be carried out, will appear between protected zone(s) A11 proximate to sensor 1 and automatic door D, the sensor failing to respond to movement of object(s) at such zone(s) A19.

Sensors capable of detecting the foregoing zone(s) A19 proximate to sensor 1 at which detection might otherwise be impossible have therefore been developed, such sensors including, for example, the sensor described at Japanese Patent No. 2871494.

The sensor described at Japanese Patent No. 2871494 is such that projected beams irradiated from a light-projecting element pass through a lens to irradiate protected zones alongside a door, reflected beams from such protected zones being condensed by way of a lens and being monitored at a light-receiving element so as to permit detection of presence and/or absence of object(s). At this sensor, a slit for regulating the projected beams and reflected beams is disposed in intervening fashion between the lens and the light-projecting and light-receiving elements, and the protected zones are given cross-sectional shapes partially approximating the more or less linear region alongside the surface of the foregoing door.

In this sensor, projected beams irradiated from a light-projecting element pass through a lens to irradiate protected zones alongside a door, reflected beams from such protected zones being condensed by way of a lens and being received at a light-receiving element. Because the aforementioned protected zones are given cross-sectional shapes partially approximating the more or less linear region alongside the surface of the aforementioned door, it is possible to cause the protected zones to closely approach the door surface.

However, with the sensor described at this Japanese Patent No. 2871494, presence of the slit which regulates the projected beams and the reflected beams makes efficient use of the projected beams impossible. That is, since the effect of blocking of light by the slit which is provided between the lens and the light-projecting and light-receiving elements is being utilized for protected zone shape, focal length must be chosen based on this slit itself; and since the amount of light that is produced which corresponds to the portion of the beams that is blocked by the slit goes to waste, it is impossible to achieve low operating cost.

Furthermore, with respect to the light irradiated by the sensor, it is preferred that the light-projecting and light-receiving elements be disposed at the focus of the lens. However, with the sensor described at this Japanese Patent No. 2871494, if the light-projecting and light-receiving elements are disposed at the focus of the lens this will result in blurring of the extents of the protected zones irradiated by the slit, and it will be impossible to cause the aforementioned protected zones to be given cross-sectional shapes partially approximating the more or less linear region alongside the surface of the door.

In order to solve one or more of the aforementioned problems, it is therefore an object of the present invention to provide a sensor making efficient use of light at light-projecting and/or light-receiving element(s) disposed at location(s) of focus or foci of lens(es) and/or other such condenser member(s); such that when carrying out detection with respect to protected zone(s) alongside light-projecting and/or light-receiving element(s), edges, on side(s) toward light-projecting and/or light-receiving element(s), of a plurality of protected zones alongside such light-projecting and/or light-receiving element(s), are formed so as to be collinear; and such that protected zone(s) nearest to such light-projecting and/or light-receiving element(s) serves or serve as protected zone(s).

SUMMARY OF INVENTION

In order to achieve the foregoing object and/or other objects, a sensor associated with one or more embodiments of the present invention comprises one or more light-projecting elements; one or more condenser members; and one or more light-receiving elements; at least one of the light-projecting element or elements irradiating at least a portion of a plurality of protected zones with light by way of at least one of the condenser member or members; light reflected from at least a portion of the protected zones being incident on at least one of the light-receiving element or elements by way of at least one of the condenser member or members; at least a portion of the light-projecting element or elements and at least a portion of the light-receiving element or elements being disposed at one or more focus or foci of at least a portion of the condenser member or members; wherein when at least one of the protected zones which is proximate to at least a portion of the light-projecting element or elements and/or at least a portion of the light-receiving element or elements is taken as reference, at least one edge, on at least one side toward at least a portion of the light-projecting element or elements and/or at least a portion of the light-receiving element or elements, of at least one of the protected zones which is located in at least one direction extending laterally from the at least one reference protected zone is formed so as to be more or less collinear with at least one edge, on at least one side toward at least a portion of the light-projecting element or elements and/or at least a portion of the light-receiving element or elements, of the at least one reference protected zone.

In accordance with such embodiment(s) of the present invention, because light-projecting and/or light-receiving element(s) may be disposed at location(s) of focus or foci of condenser member(s), and because when protected zone(s) proximate to light-projecting and/or light-receiving element(s) is/are taken as reference(s), edge(s), on side(s) toward light-projecting and/or light-receiving element(s), of protected zone(s) located in direction(s) extending laterally from such reference protected zone(s) is/are formed so as to be more or less collinear with edge(s), on side(s) toward light-projecting and/or light-receiving element(s), of reference protected zone(s), it is possible to make efficient use of light at light-projecting and/or light-receiving element(s) disposed at location(s) of focus or foci of lens(es) and/or other such condenser member(s). Moreover, it is also possible, when carrying out detection with respect to protected zone(s) alongside light-projecting and/or light-receiving element(s), to cause edges, on side(s) toward light-projecting and/or light-receiving element(s), of a plurality of protected zones alongside such light-projecting and/or light-receiving element(s), to be formed so as to be collinear; and to cause zone(s) nearest to such light-projecting and/or light-receiving element(s) to serve as protected zone(s).

More specifically, in the foregoing constitution, at least one of the condenser member or members may be formed such that there are a plurality of condenser regions arrayed therein; and at least one of the condenser regions which is designed to irradiate at least a portion of the at least one reference protected zone may serve as axis about which at least one of the condenser regions which is designed to irradiate at least a portion of at least one of the protected zones which is located in at least one direction extending laterally therefrom may be disposed in inclined fashion.

Where this is the case, because condenser region(s) designed to irradiate reference protected zone(s) serves or serve as axis or axes about which condenser region(s) designed to irradiate protected zone(s) located in direction(s) extending laterally therefrom is/are disposed in inclined fashion, even where the characteristics of light cause zone extent to increase as one goes from protected zone(s) proximate to light-projecting and/or light-receiving element(s) to protected zone(s) located in direction(s) extending laterally therefrom, it is possible to prevent zone(s) nearest to light-projecting and/or light-receiving element(s) from being unprotected zone(s) and to cause edge(s) at the light-projecting and/or light-receiving element side(s) of plurality of protected zones alongside light-projecting and/or light-receiving element(s) to be formed so as to be collinear.

Furthermore, at least one of the condenser member or members may be formed such that there are a plurality of condenser regions arrayed therein; and at least a portion of the respective focal lengths from at least one of the light-projecting and/or light-receiving elements to the plurality of condenser regions may be set such that at least one focal length therefrom to at least one of the condenser region or regions designed to irradiate at least a portion of the protected zone or zones located in the direction or directions extending laterally is greater than at least one focal length therefrom to at least one of the condenser region or regions designed to irradiate at least a portion of the reference protected zone or zones.

Where this is the case, because respective focal lengths from light-projecting and/or light-receiving element(s) to plurality of condenser regions are set such that focal length(s) therefrom to condenser region(s) designed to irradiate protected zone(s) located in direction(s) extending laterally is/are greater than focal length(s) therefrom to condenser region(s) designed to irradiate reference protected zone(s), it is possible through employment of the characteristics of light to prevent zone extent from increasing as one goes from protected zone(s) proximate to light-projecting and/or light-receiving element(s) to protected zone(s) located in direction(s) extending laterally therefrom. This being the case, it will be possible to prevent zone(s) nearest to light-projecting and/or light-receiving element(s) from being unprotected zone(s) and it will be possible to cause edge(s) at the light-projecting and/or light-receiving element side(s) of plurality of protected zones alongside light-projecting and/or light-receiving element(s) to be formed so as to be collinear.

Still more specifically, in the foregoing constitution, at least one of the condenser member or members may be formed such that there are a plurality of lenses arrayed therein.

Alternatively or in addition thereto, at least one of the condenser member or members may be at least one prism, at least one lens being disposed at at least one side thereof toward at least one of the light-projecting and/or light-receiving elements.

Alternatively or in addition thereto, at least one of the condenser member or members may be formed such that there are a plurality of mirrors arrayed therein.

BRIEF DESCRIPTION OF DRAWINGS

FIG. 1 (*b*) is a schematic diagram of the structure of a light-receiving component provided in a sensor associated with a first embodiment.

FIG. 2 (*b*) is a schematic front view showing protected zones at an automatic door where a sensor associated with a first embodiment is employed.

FIG. 3 (*a*) is a schematic plan view of lens group(s) provided in a sensor associated with a first embodiment.

FIG. 4 (*b*) is a schematic plan view of lens group(s) provided in another working example of a sensor associated with a first embodiment.

FIG. 5 (*b*) is a schematic plan view of prisms provided in another working example of a sensor associated with a first embodiment.

FIG. 6 (*b*) is a schematic plan view of prisms provided in another working example of a sensor associated with a first embodiment.

FIG. 7 (*b*) is a schematic diagram of the structure of a light-receiving component employing mirrors as condenser members and provided in a sensor associated with a first embodiment.

FIG. 8 (*b*) is a schematic front view of mirror group(s) provided in another working example of a sensor associated with a first embodiment.

FIG. 9 (*b*) is a schematic front view of mirror group(s) provided in another working example of a sensor associated with a first embodiment.

FIG. 10 (*b*) is a schematic front view showing protected zones at an automatic door where a sensor associated with a second embodiment is employed.

FIG. 11 (*b*) is a schematic plan view of lens group(s) provided in a sensor associated with a second embodiment.

FIG. 12 (*b*) is a schematic front view of mirror group(s) provided in another working example of a sensor associated with a second embodiment.

FIG. 13 (*b*) is a schematic front view showing protected zones at an automatic door where a conventional sensor is employed.

DESCRIPTION OF PREFERRED EMBODIMENTS

Below, embodiments of the present invention are described with reference to the drawings. Note that while the following embodiments apply the present invention to an automatic door sensor, this being one type of sensor, the present invention is not limited thereto, it being possible to apply the present invention to sensors used in other fields, e.g., security sensors and the like.

First Embodiment

Figure 1:
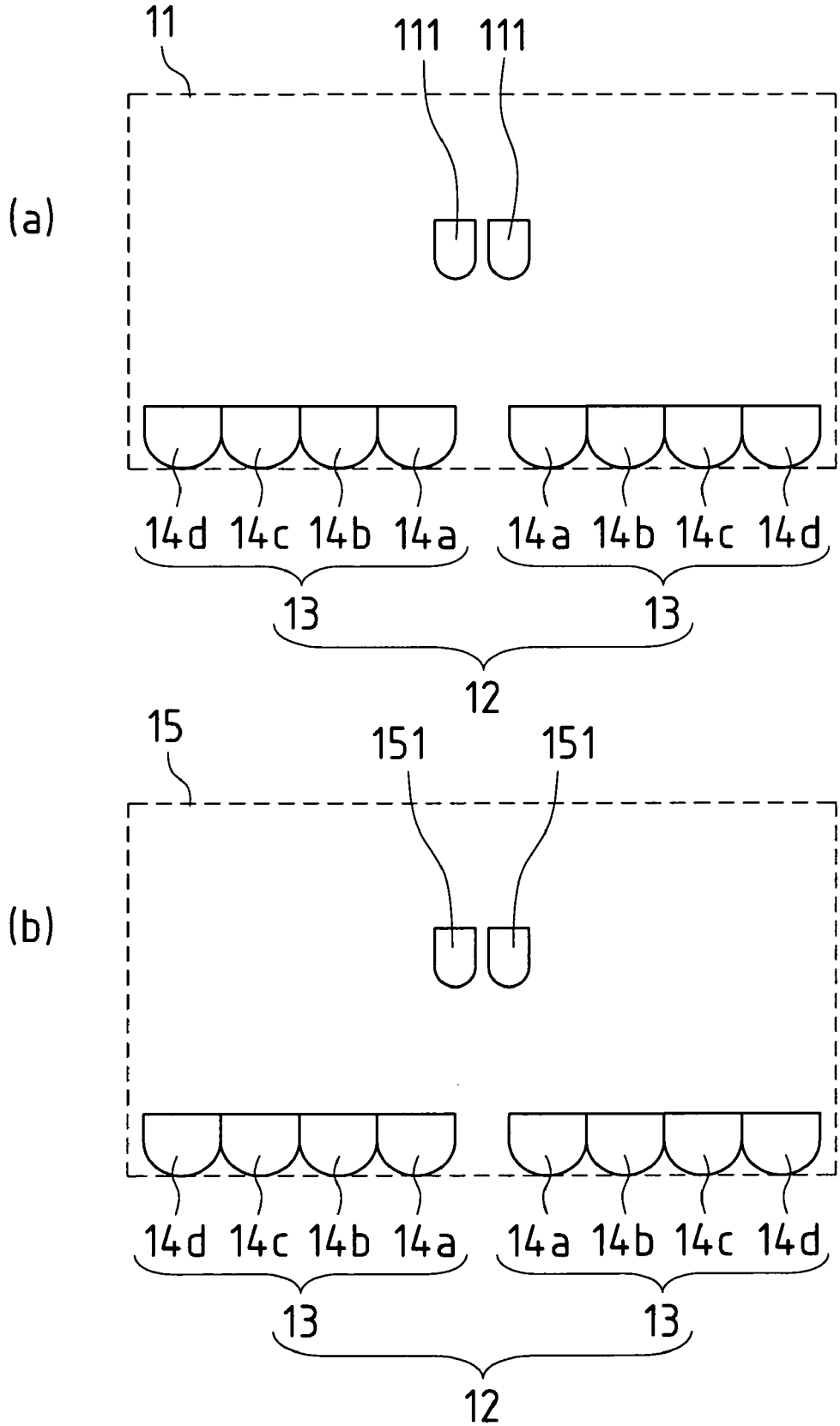
FIG. 1 (*a*) is a schematic diagram of the structure of a light-projecting component provided in a sensor associated with a first embodiment.
Figure 2:
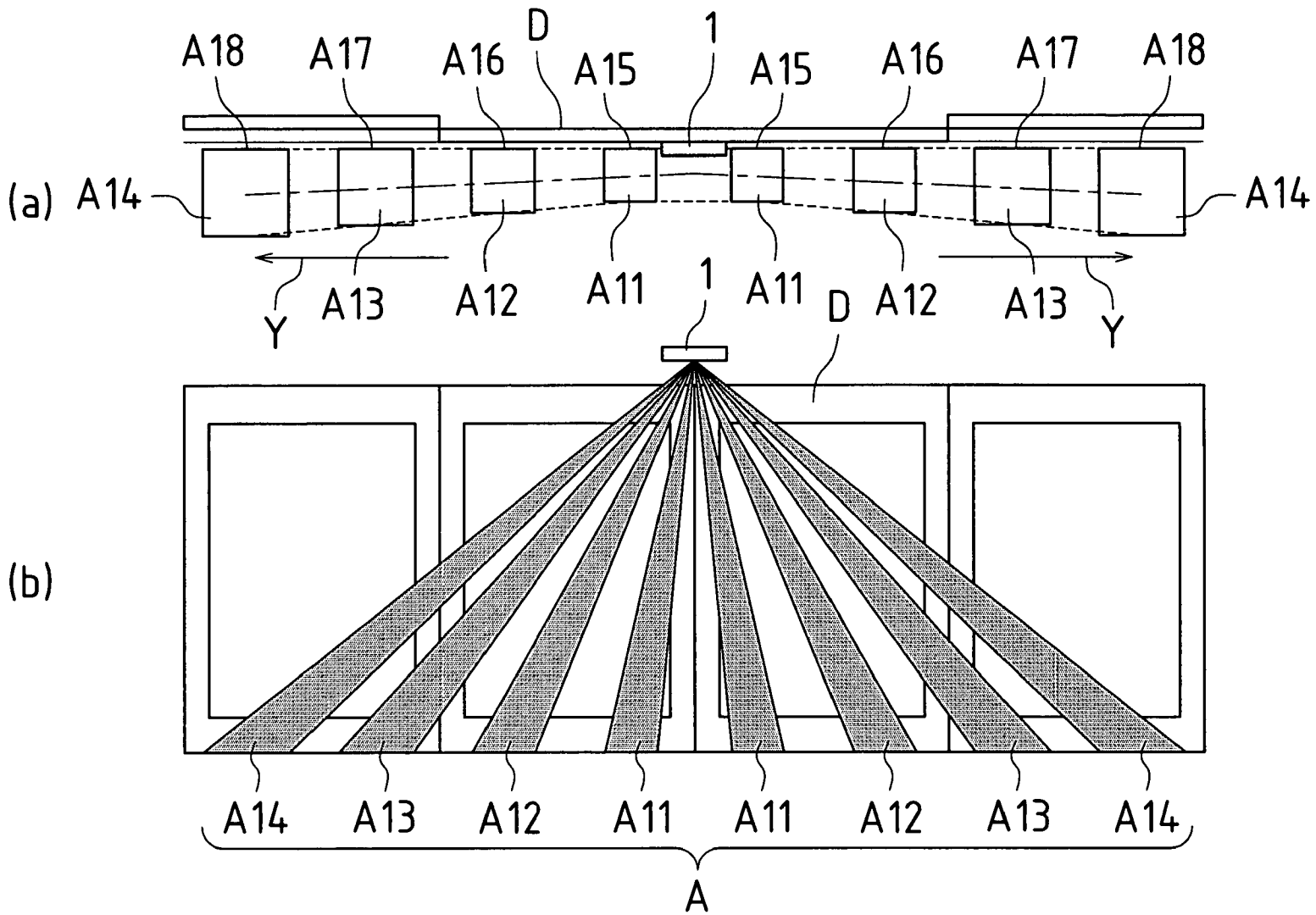
FIG. 2 (*a*) is a schematic plan view showing protected zones at an automatic door where a sensor associated with a first embodiment is employed.
Figure 3:
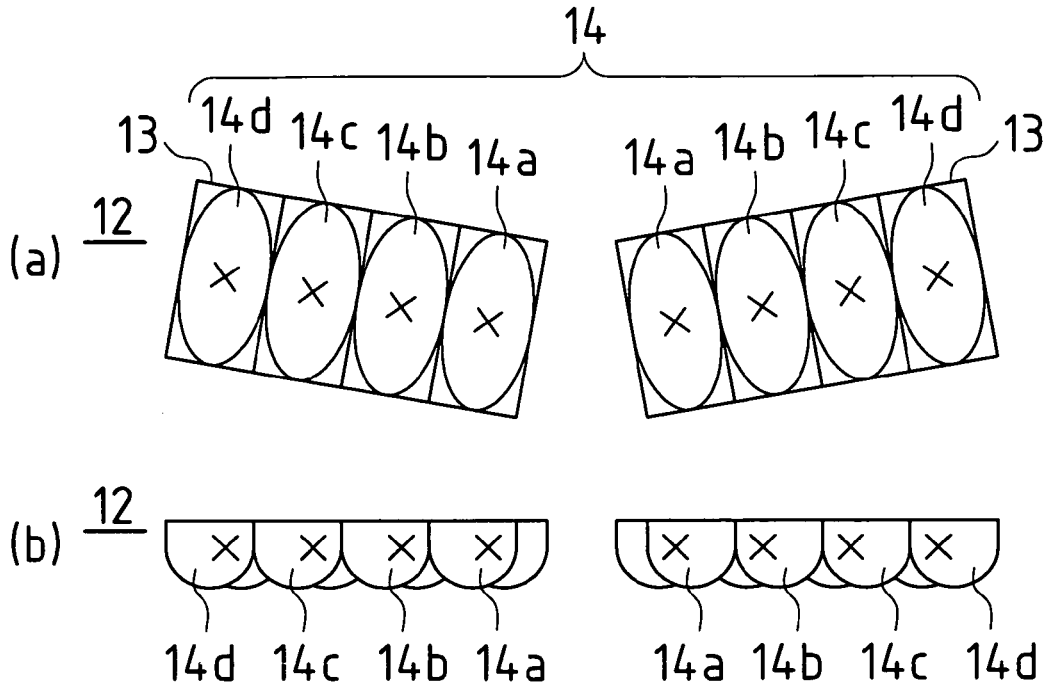
FIG. 3 (*a*) is a schematic front view of lens group(s) provided in a sensor associated with a first embodiment.

The sensor associated with the present first embodiment is shown in FIGS. 1 through 3.

As shown in FIG. 1, this sensor 1 is provided above the central region of automatic door D (see FIG. 2) and is such that arrayed therein (not shown) there are light-projecting component(s) 11 irradiating light from two light-projecting elements 111 by way of lens group(s) 12 ("condenser member(s)" in the language of the present invention); and light-receiving component(s) 15 at which light irradiated from such light-projecting component(s) 11 is, after being reflected, incident on two light-receiving elements 151 by way of lens group(s) 12.

As shown in FIG. 3, lens group(s) 12 is/are formed such that eight lenses 14 which are convex on one side are arrayed therein. These eight lenses 14 are divided into two lens sets 13, each of which comprises four lenses 14*a*, 14*b*, 14*c*, 14*d*. At these two lens sets 13—each of which comprises four lenses 14*a*, 14*b*, 14*c*, 14*d*—lens 14*a*, which is designed to irradiate reference protected zone A11 (see FIG. 2) located proximate to sensor 1, serves as axis, about which the other three lenses 14*b*, 14*c*, 14*d*, which are designed to irradiate protected zones A12, A13, A14 located in the Y direction (see FIG. 2) extending outward alongside the surface of automatic door D, are disposed in inclined fashion. Furthermore, the eight lenses of the lens sets 13 are themselves arranged so as to be inclined in V-shaped fashion such that the four lenses 14*a*, 14*b*, 14*c*, 14*d* of each of the two lens sets 13 occupy respectively symmetric locations (see FIG. 3).

Note that at FIG. 3, the symbol x indicates the principal point of the lens. Furthermore, at this sensor 1, light-projecting and light-receiving elements 111, 151 are respectively disposed at the foci of the two lens sets 13, the respective distances from light-projecting and light-receiving elements 111, 151 to the eight lenses 14 representing the focal lengths established therefor (see FIG. 1).

The positional relationship between such lens group(s) 12 and light-projecting and light-receiving elements 111, 151 is such that edges A16, A17, A18 at the automatic door D side of protected zones A12, A13, A14 located in the Y direction(s) extending outward alongside the surface of automatic door D from reference protected zone(s) A11 located proximate to sensor 1 are formed so as to be collinear with edge(s) A15 at the automatic door D side of reference protected zone(s) A11.

That is, as shown in FIG. 2, the eight lenses 14 arranged in V-shaped fashion are such that a line drawn through the centers of reference protected zones A11 and protected zones A12, A13, A14 located in the Y directions extending outward alongside the surface of automatic door D will form a V-shaped line. This being the case, the distance between automatic door D and edges A15, A16, A17, A18 at the automatic door D side of protected zones A11, A12, A13, A14 is constant.

As described above, because this sensor 1 is such that light-projecting and light-receiving elements 111, 151 are respectively disposed at foci of two lens sets 13, and because, taking reference protected zone(s) A11 as reference(s), edges A16, A17, A18 at the automatic door D side of protected zones A12, A13, A14 located in the Y direction(s) extending outward alongside the surface of automatic door D from such reference protected zone(s) A11 are formed so as to be collinear with edge(s) A15 at the automatic door D side of reference protected zone(s) A11, it is possible to make efficient use of light at light-projecting and light-receiving elements 111, 151 respectively disposed at foci of two lens sets 13. Moreover, when carrying out detection with respect to protected zone(s) A alongside sensor 1, edges A15, A16, A17, A18 at the automatic door D side of plurality of protected zones A11, A12, A13, A14 alongside such light-projecting and/or light-receiving element(s) 111, 151 may be formed so as to be collinear, and zone(s) nearest to sensor 1 may serve as protected zone(s).

Furthermore, because lens(es) 14*a*, designed to irradiate reference protected zone(s) A11, serve as axis, about which lenses 14*b*, 14*c*, 14*d*, designed to irradiate protected zones A12, A13, A14 located in Y direction(s) extending outward alongside the surface of automatic door D, are arranged so as to be inclined in V-shaped fashion, even where the characteristics of light cause zone extent to increase as one goes from reference protected zone(s) A11 to protected zones A12, A13, A14 located in Y direction(s) extending outward alongside the surface of automatic door D, it is possible to prevent zone(s) nearest to sensor 1 from being unprotected zone(s) and to cause edges A15, A16, A17, A18 at the automatic door D side of plurality of protected zones A11, A12, A13, A14 alongside automatic door D to be formed so as to be collinear.

Note that whereas in the present first embodiment two lens sets 13 exist in divided form, the present invention is not limited thereto; it being possible for same to be arrayed in continuous fashion.

Furthermore, whereas in the present first embodiment lenses 14 are formed so as to be convex on one side, the present invention is not limited thereto; it being possible for same to be formed so as to be biconvex in shape.

Furthermore, whereas in the present first embodiment eight lenses 14 were employed, the present invention is not limited thereto; it being possible to choose an arbitrary number, e.g., 10, thereof.

Furthermore, whereas in the present first embodiment two light-projecting and two light-receiving elements 111, 151 were disposed therein, the present invention is not limited thereto; it being possible to choose an arbitrary number thereof.

Furthermore, whereas in the present first embodiment lenses 14 were employed as condenser member(s), the present invention is not limited thereto; it being possible to employ other member(s), provided only that such other member(s) be condenser member(s) suited to the task of, taking reference protected zone(s) A11 as reference(s), causing edges A16, A 17, A18 at the automatic door D side of protected zones A12, A13, A14 located in the Y direction(s) extending outward alongside the surface of automatic door D from such reference protected zone(s) A11 to be formed so as to be collinear with edge(s) A15 at the automatic door D side of reference protected zone(s) A11.

Figure 4:
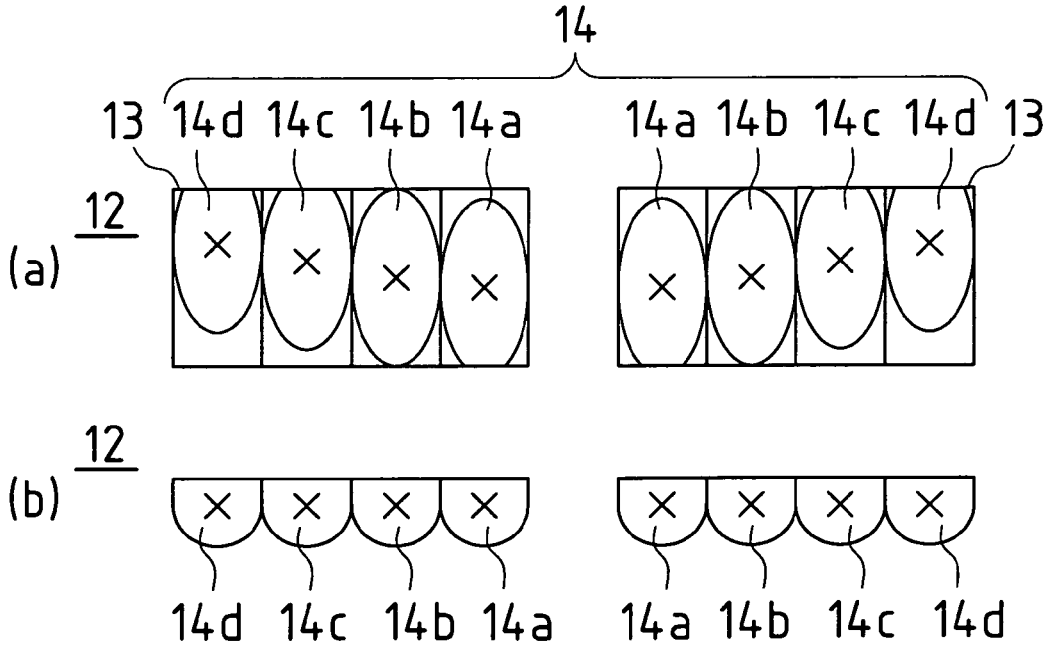
FIG. 4 (*a*) is a schematic front view of lens group(s) provided in another working example of a sensor associated with a first embodiment.
Figure 5:
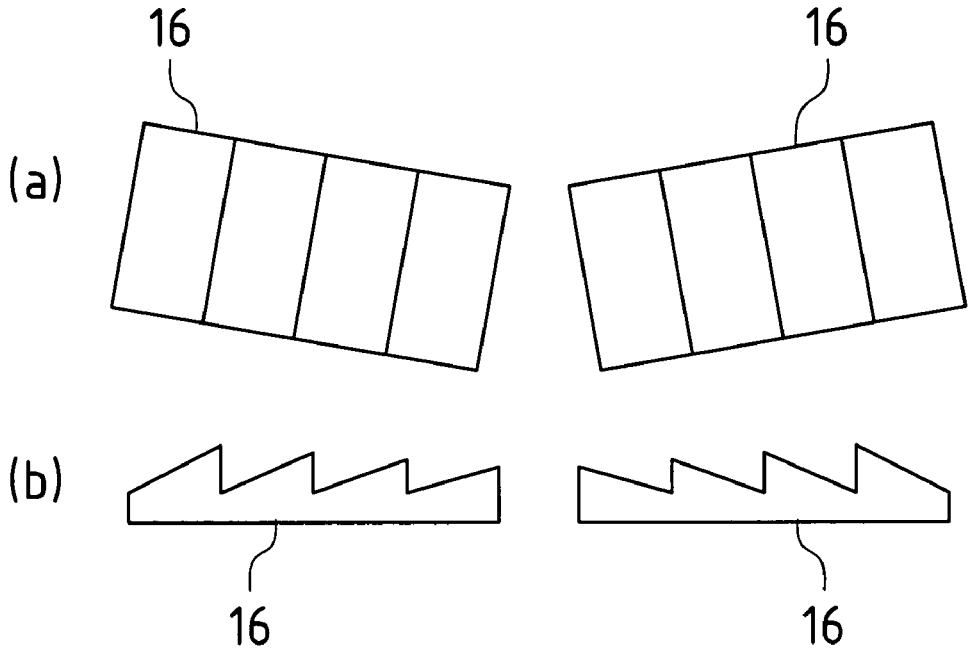
FIG. 5 (*a*) is a schematic front view of prisms provided in another working example of a sensor associated with a first embodiment.
Figure 6:
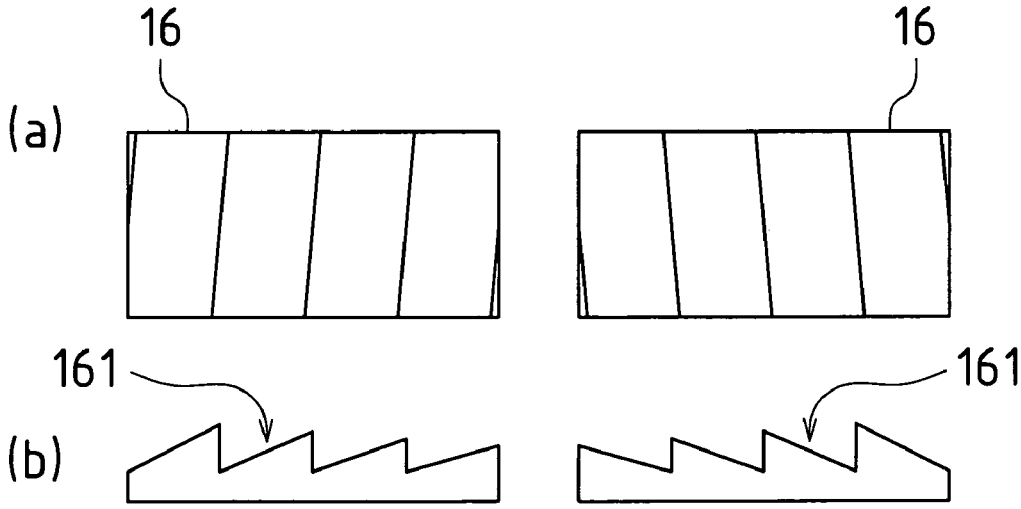
FIG. 6 (*a*) is a schematic front view of prisms provided in another working example of a sensor associated with a first embodiment.
Figure 8:
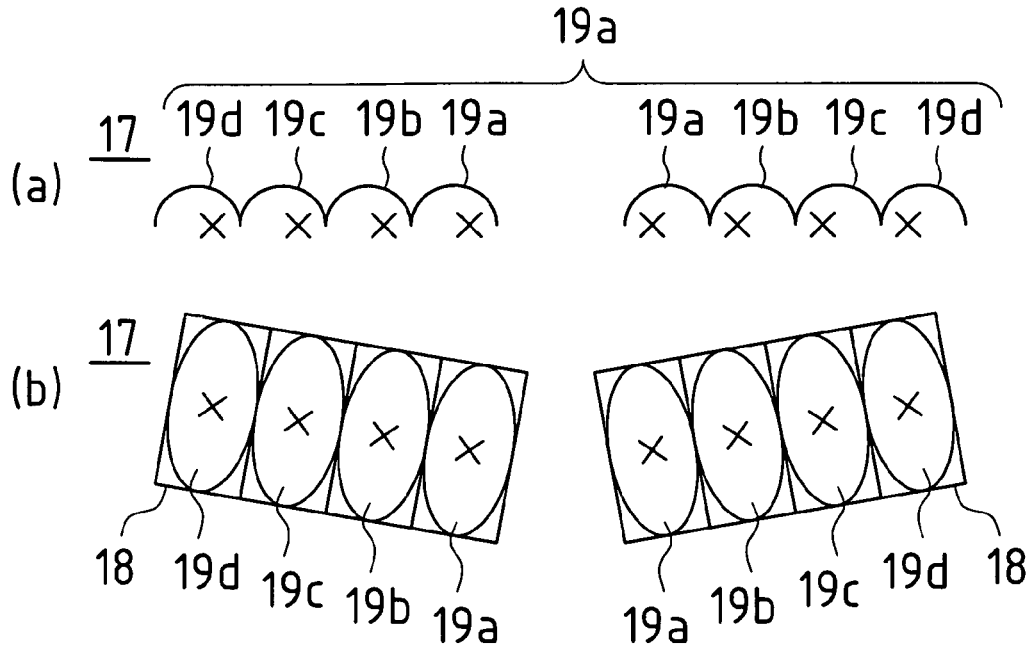
FIG. 8 (*a*) is a schematic plan view of mirror group(s) provided in another working example of a sensor associated with a first embodiment.
Figure 9:
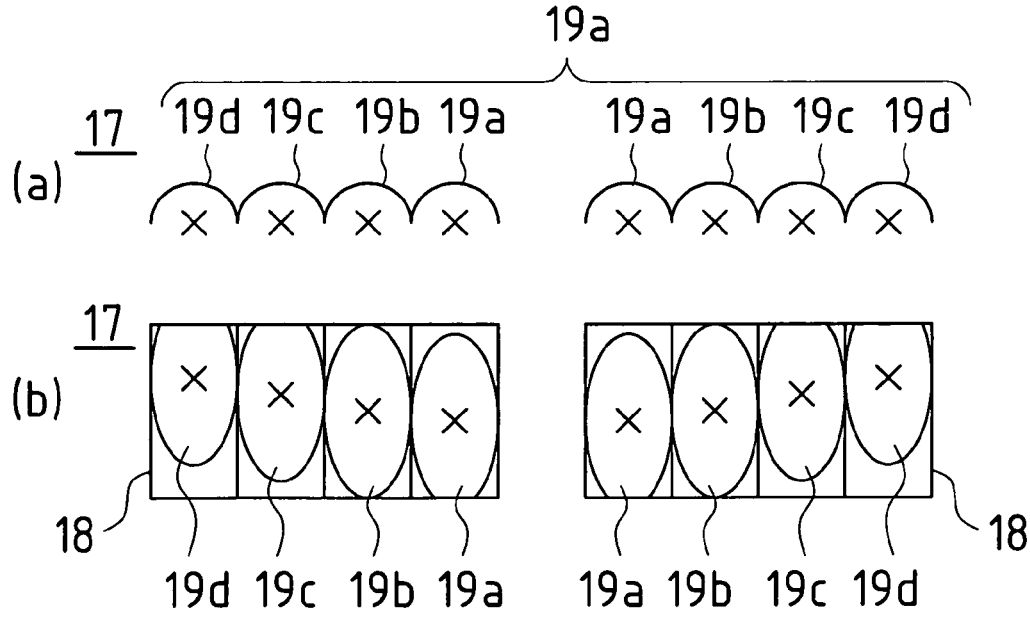
FIG. 9 (*a*) is a schematic plan view of mirror group(s) provided in another working example of a sensor associated with a first embodiment.

Such other member(s) may for example be formed such that eight lenses 14 are arrayed therein as shown in FIG. 4, or may be prism(s) 16 to the automatic door D side of which eight lenses (not shown) are disposed as shown in FIG. 5 or 6, or may be formed such that eight mirrors 19 are arrayed therein as shown in FIG. 8 or 9.

In a sensor employing the eight lenses 14 shown in FIG. 4, lens sets 13 are, unlike the present first embodiment, not themselves arranged so as to be inclined in V-shaped fashion, but instead the principal points × of the eight lenses 14 are arranged so as to be inclined in V-shaped fashion.

Furthermore, in a sensor employing the prism(s) 16 shown in FIG. 5, the prism(s) 16 employed is/are such that lens(es) (not shown) is/are disposed at side(s) thereof toward the two sets of light-projecting and light-receiving elements 111, 151, the two sets of prism(s) 16 being themselves disposed so as to be inclined in V-shaped fashion in similar manner as at the present first embodiment.

Furthermore, in a sensor employing the prism(s) 16 shown in FIG. 6, the prism(s) 16 employed is/are such that lens(es) (not shown) is/are disposed at side(s) thereof toward the two sets of light-projecting and light-receiving elements 111, 151, and unlike the present first embodiment, refracting surface(s) 161 of the two sets of prism(s) 16 is/are disposed so as to be inclined in V-shaped fashion.

Figure 7:
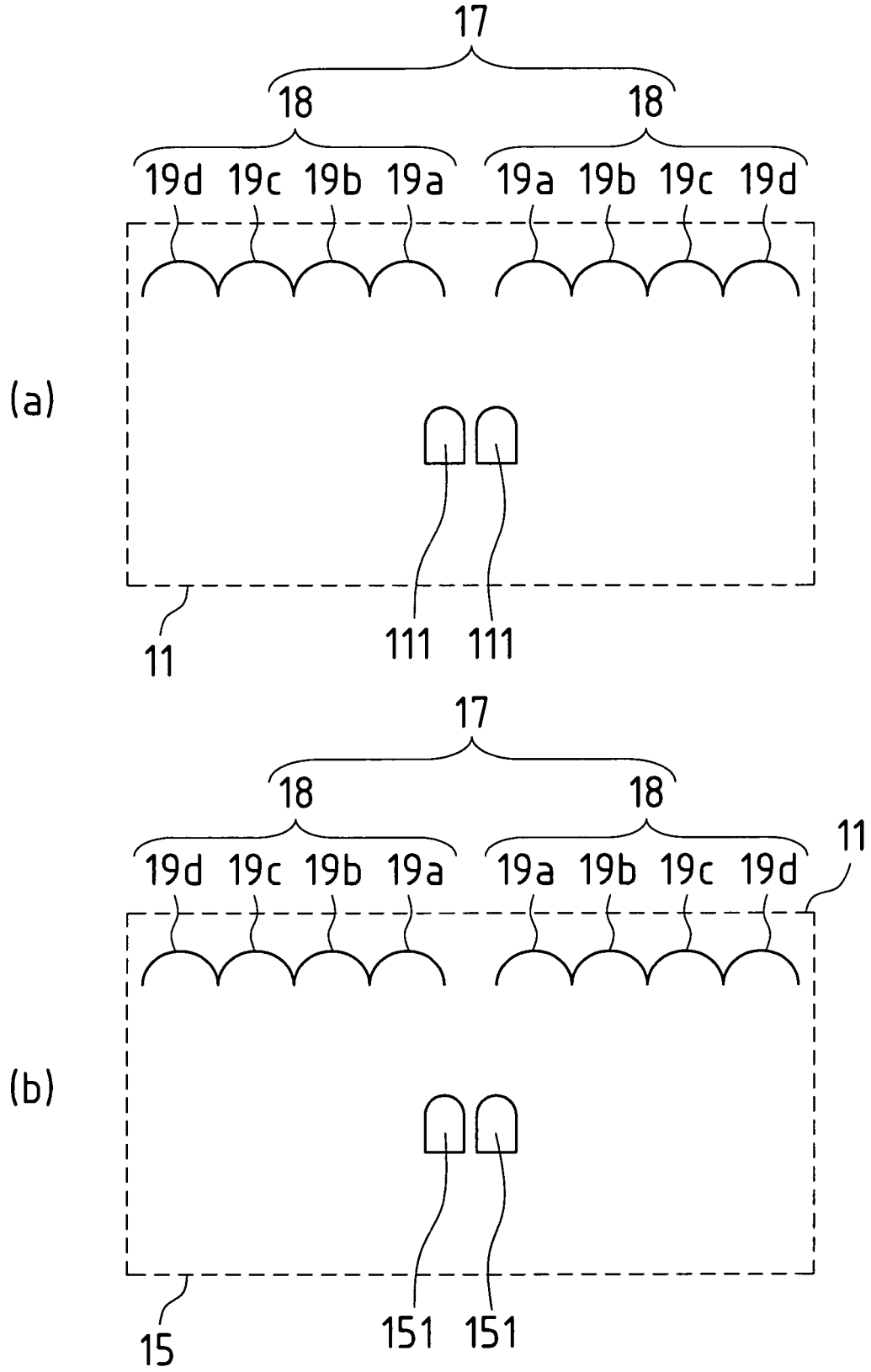
FIG. 7 (*a*) is a schematic diagram of the structure of a light-projecting component employing mirrors as condenser members and provided in a sensor associated with a first embodiment.

Furthermore, in a sensor employing the mirror(s) 19 shown in FIG. 8, mirror group(s) 17 is/are formed such that eight mirrors 19 which are convex on one side are arrayed therein as shown in FIG. 7, in similar manner as at the present first embodiment. These eight mirrors 19 are divided into two mirror sets 18, each of which comprises four mirrors 19*a*, 19*b*, 19*c*, 19*d*. The eight mirrors of these mirror sets 18 are themselves arranged so as to be inclined in V-shaped fashion such that the four mirrors 19 of each of the two mirror sets 18 occupy respectively symmetric locations.

Furthermore, in a sensor employing the mirror(s) 19 shown in FIG. 9, mirror group(s) 17 is/are formed such that eight mirrors 19 which are convex on one side are arrayed therein as shown in FIG. 7. These eight mirrors 19 are divided into two mirror sets 18, each of which comprises four mirrors 19*a*, 19*b*, 19*c*, 19*d*, and unlike the present first embodiment, the two mirror sets 18 are not themselves arranged so as to be inclined in V-shaped fashion, but instead the principal points x of the eight mirrors 19 are arranged so as to be inclined in V-shaped fashion.

Second Embodiment

The sensor of the second embodiment differs from sensor 1 of the foregoing first embodiment only with respect to the fact that, taking reference protected zone(s) A11 as reference(s), edges A16, A17, A18 at the automatic door D side of protected zones A12, A13, A14 located in the Y direction(s) extending outward alongside the surface of automatic door D from such reference protected zone(s) A11 are formed so as to be collinear with edge(s) A15 at the automatic door D side of reference protected zone(s) A11, the constitutions thereof being identical in other respects. Description of the present second embodiment will therefore be confined to those features with respect to which it differs from sensor 1 of the first embodiment, and like constituents will be assigned like reference numerals and description thereof will be omitted.

This sensor 1 is provided above the central region of automatic door D (see FIG. 10) and is such that arrayed vertically therein (not shown) there are light-projecting component(s) 11 irradiating light from two light-projecting elements 111 by way of lens group(s) 22; and light-receiving component(s) 15 at which light irradiated from such light-projecting component(s) 11 is, after being reflected, incident on two light-receiving elements 151 by way of lens group(s) 22.

Figure 11:
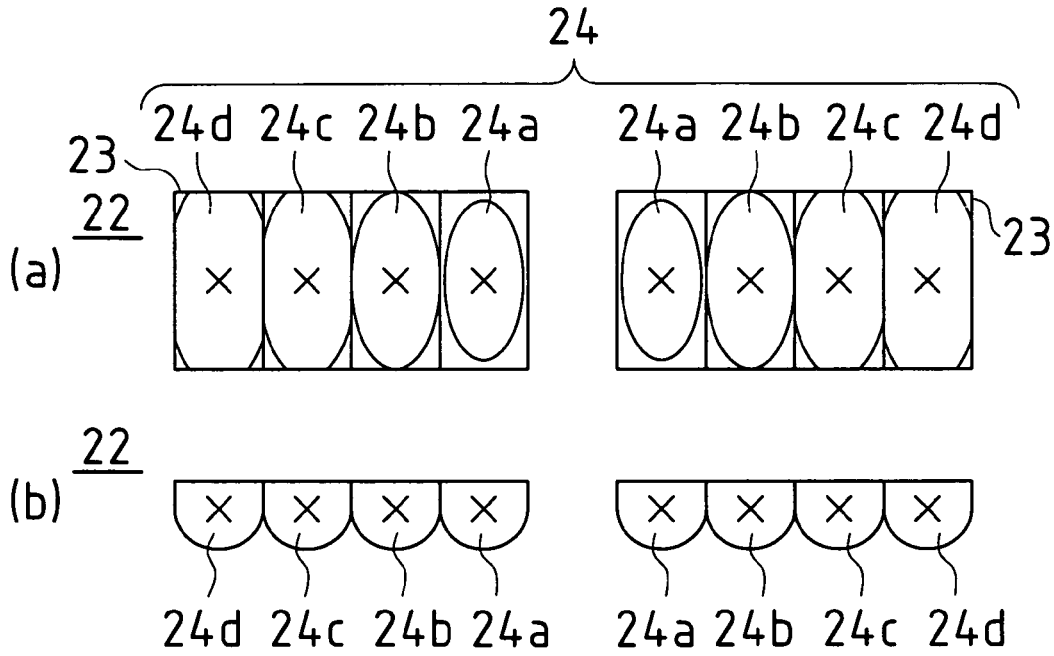
FIG. 11 (*a*) is a schematic front view of lens group(s) provided in a sensor associated with a second embodiment.

As shown in FIG. 11, lens group(s) 22 is/are formed such that eight lenses 24 which are convex on one side are arrayed therein. These eight lenses 24 are divided into two lens sets 23, each of which comprises four lenses 24 (24*a*, 24*b*, 24*c*, 24*d*).

Furthermore, light-projecting and light-receiving elements 111, 151 are respectively disposed at the foci of the two lens sets 23, the respective distances from light-projecting and light-receiving elements 111, 151 to the eight lenses 24 representing the focal lengths established therefor. The respective focal lengths are set such that focal lengths to lenses 24*b*, 24*c*, 24*d* designed to irradiate protected zones A22, A23, A24 located in Y direction(s) extending outward alongside the surface of automatic door D are greater by successively greater amounts than focal length(s) to lens(es) 24*a* designed to irradiate reference protected zone(s) A21. This being the case, as shown in FIG. 10, given constant distance from sensor 1 (reference numeral Z; see FIG. 10), the greater the distance a protected zone is from sensor 1 the smaller will be the protected zone.

Figure 10:
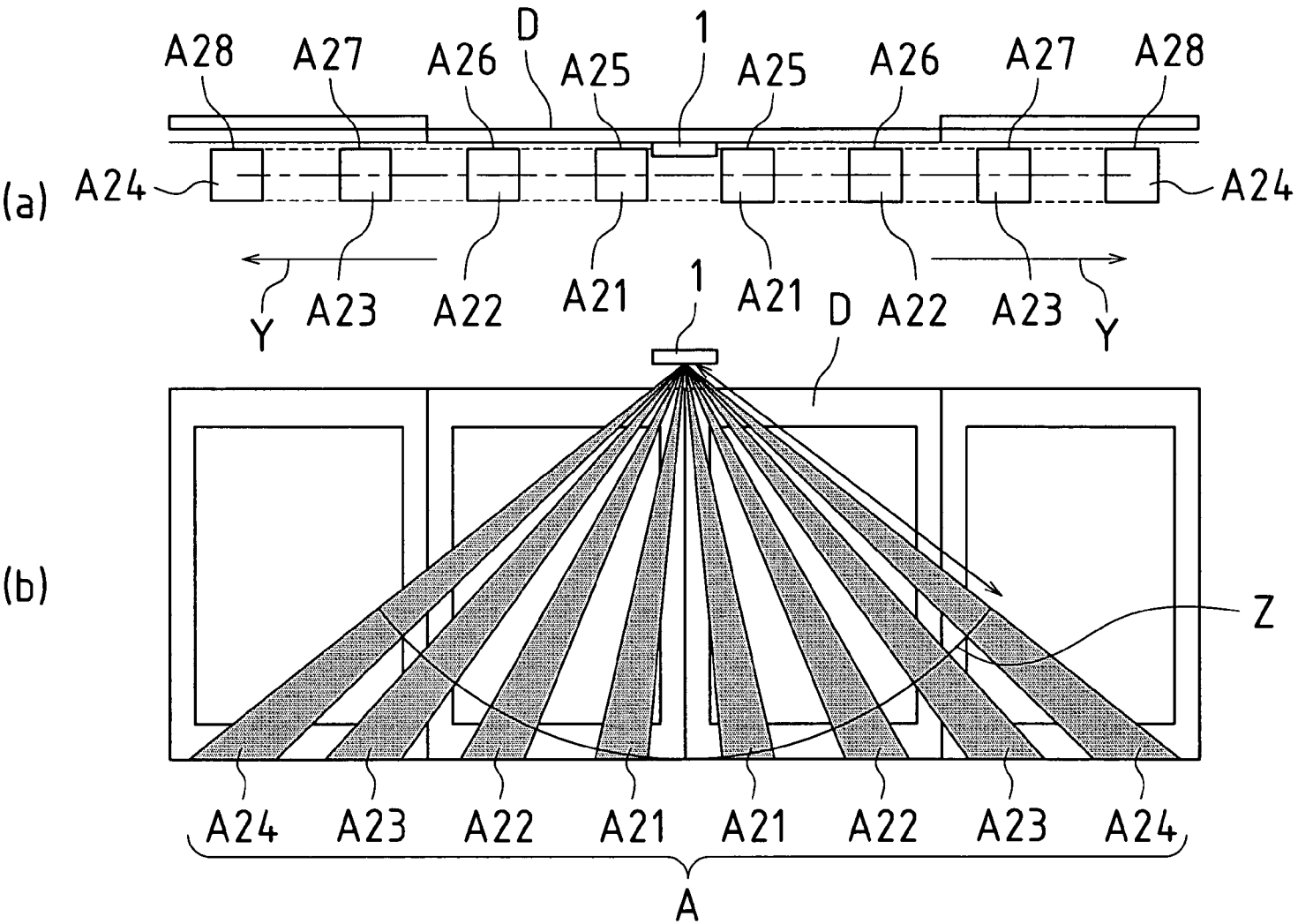
FIG. 10 (*a*) is a schematic plan view showing protected zones at an automatic door where a sensor associated with a second embodiment is employed.

The relationship among focal lengths from light-projecting and light-receiving elements 111, 151 to respective lenses 24 is such that, as shown in FIG. 10, edges A26, A27, A28 at the automatic door D side of protected zones A22, A23, A24 located in the Y direction(s) extending outward alongside the surface of automatic door D from reference protected zone(s) A21 located proximate to sensor 1 are formed so as to be collinear with edge(s) A25 at the automatic door D side of reference protected zone(s) A21.

That is, as shown in FIG. 10, the eight lenses 24 are such that a line drawn through the centers of reference protected zone(s) A21 and protected zones A22, A23, A24 located in the Y direction(s) extending outward alongside the surface of automatic door D will be formed such that it is collinear with the surface of automatic door D. This being the case, the distance between automatic door D and edges A25, A26, A27, A28 at the automatic door D side of protected zones A21, A22, A23, A24 is constant.

As described above, because this sensor 1 is such that light-projecting and light-receiving elements 111, 151 are respectively disposed at foci of two lens sets 23, because distances from light-projecting and light-receiving elements

111, 151 to eight lenses 24 are focal lengths established therefor, and because, taking reference protected zone(s) A21 as reference(s), edges A26, A27, A28 at the automatic door D side of protected zones A22, A23, A24 located in the Y direction(s) extending outward alongside the surface of automatic door D from such reference protected zone(s) A21 are formed so as to be collinear with edge(s) A25 at the automatic door D side of reference protected zone(s) A21, it is possible to make efficient use of light at light-projecting and light-receiving elements 111, 151 respectively disposed at foci of two lens sets 23. Moreover, when carrying out detection with respect to protected zone(s) A alongside sensor 1, edges A25, A26, A27, A28 at the automatic door D side of plurality of protected zones A21, A22, A23, A24 alongside such sensor 1 may be formed so as to be collinear, and zone(s) nearest to sensor 1 may serve as protected zone(s).

Furthermore, because focal lengths from light-projecting and/or light-receiving elements 111, 151 to eight lenses 24 are respectively set such that focal lengths to lenses 24*b*, 24*c*, 24*d* designed to irradiate protected zones A22, A23, A24 located in Y direction(s) extending outward alongside the surface of automatic door D are greater by successively greater amounts than focal length(s) to lens(es) 24*a* designed to irradiate reference protected zone(s) A21, it is possible through employment of the characteristics of light to prevent zone extent from increasing as one goes from reference protected zone(s) A21 to protected zones A22, A23, A24 located in Y direction(s) extending outward alongside the surface of automatic door D. This being the case, it is possible to prevent zone(s) nearest to light-projecting and/or light-receiving elements 111, 151 from being unprotected zone(s) and it is possible to cause edges A25, A26, A27, A28 at the automatic door D side of plurality of protected zones A21, A22, A23, A24 alongside automatic door D to be formed so as to be collinear.

Furthermore, because, as shown in FIG. 10, the eight lenses 24 are such that a line drawn through the centers of reference protected zone(s) A21 and protected zones A22, A23, A24 located in the Y direction(s) extending outward alongside the surface of automatic door D will be formed such that it is collinear with the surface of automatic door D, this is preferred when forming protected zones in matrix fashion.

Note also that whereas in the present second embodiment lenses 24 were employed as condenser member(s), the present invention is not limited thereto; it being possible to employ other member(s), provided only that such other member(s) be condenser member(s) suited to the task of, taking reference protected zone(s) A21 as reference(s), causing edges A26, A27, A28 at the automatic door D side of protected zones A22, A23, A24 located in the Y direction(s) extending outward alongside the surface of automatic door D from such reference protected zone(s) A21 to be formed so as to be collinear with edge(s) A25 at the automatic door D side of reference protected zone(s) A21.

Figure 12:
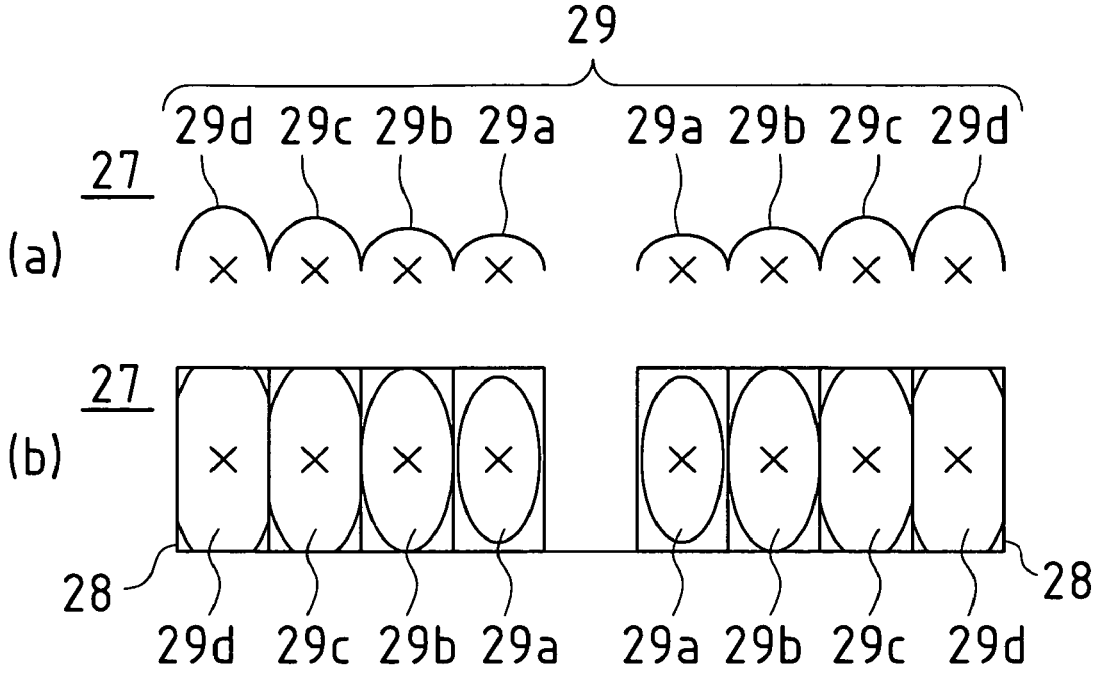
FIG. 12 (*a*) is a schematic plan view of mirror group(s) provided in another working example of a sensor associated with a second embodiment.
Figure 13:
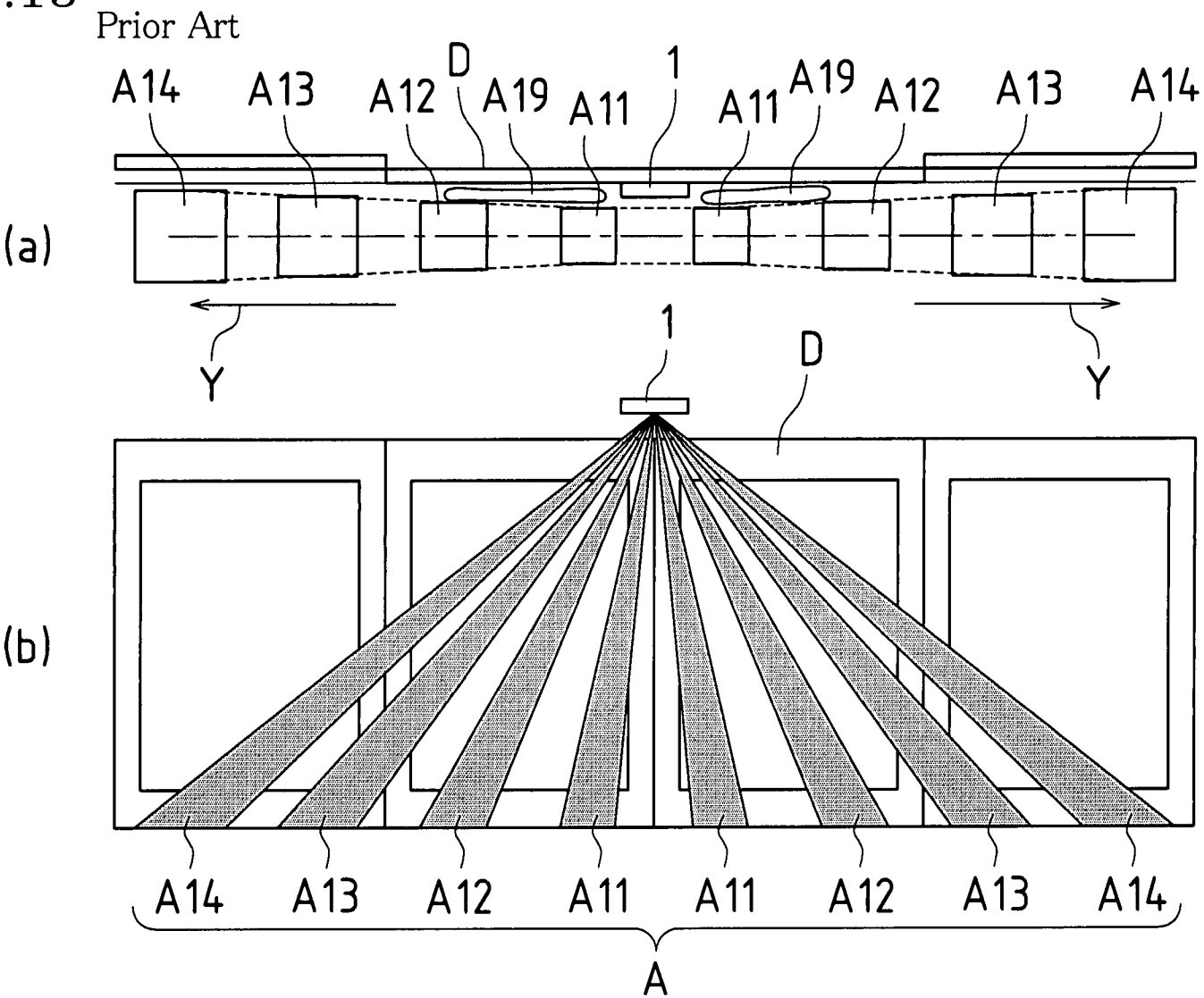
FIG.13 Prior Art
FIG. 13 (*a*) is a schematic plan view showing protected zones at an automatic door where a conventional sensor is employed.

Such other member(s) may for example be mirror group (s) 27 formed such that eight mirrors 29 are arrayed therein as shown in FIG. 12. In a sensor employing such eight mirrors 29, mirror group(s) 27 is/are formed such that eight mirrors 29 which are convex on one side are arrayed therein. These eight mirrors 29 are divided into two mirror sets 28, each of which comprises four mirrors 29*a*, 29*b*, 29*c*, 29*d*; light-projecting and light-receiving elements 111, 151 being disposed at foci of the two mirror sets 28 in similar manner as at the present second embodiment. The respective distances from light-projecting and light-receiving elements 111, 151 to the eight mirrors 29 are focal lengths established therefor, and the respective focal lengths are set such that focal lengths to mirrors 29*b*, 29*c*, 29*d* designed to irradiate protected zones A22, A23, A29 located in Y direction(s) extending outward alongside the surface of automatic door D are greater by successively greater amounts than focal length(s) to mirror(s) 29*a* designed to irradiate reference protected zone(s) A21.

As described above with reference to the first and second embodiments, sensor(s) associated with embodiment(s) of the present invention permit efficient use of light at light-projecting and/or light-receiving element(s) disposed at location(s) of focus or foci of lens(es) and/or other such condenser member(s); make it possible, when carrying out detection with respect to protected zone(s) alongside light-projecting and/or light-receiving element(s), to cause edges, on side(s) toward light-projecting and/or light-receiving element(s), of a plurality of protected zones alongside such light-projecting and/or light-receiving element(s), to be formed so as to be collinear; and make it possible to cause zone(s) nearest to light-projecting and/or light-receiving element(s) to serve as protected zone(s).

That is, with sensor(s) associated with embodiment(s) of the present invention, because light-projecting and/or light-receiving element(s) may be disposed at location(s) of focus or foci of condenser member(s), and because when protected zone(s) proximate to light-projecting and/or light-receiving element(s) is/are taken as reference(s), edge(s), on side(s) toward light-projecting and/or light-receiving element(s), of protected zone(s) located in direction(s) extending laterally from such reference protected zone(s) is/are formed so as to be more or less collinear with edge(s), on side(s) toward light-projecting and/or light-receiving element(s), of reference protected zone(s), it is possible to make efficient use of light at light-projecting and/or light-receiving element(s) disposed at location(s) of focus or foci of lens(es) and/or other such condenser member(s). Moreover, it is also possible, when carrying out detection with respect to protected zone(s) alongside light-projecting and/or light-receiving element(s), to cause edges, on side(s) toward light-projecting and/or light-receiving element(s), of a plurality of protected zones alongside such light-projecting and/or light-receiving element(s), to be formed so as to be collinear; and to cause zone(s) nearest to light-projecting and/or light-receiving element(s) to serve as protected zone(s).

What is claimed is:

1. A sensor capable of detecting of one or more objects, the sensor comprising:

one or more light-projecting elements;

one or more condenser members; and one or more light-receiving elements;

at least one of the light-projecting element or elements irradiating at least a portion of a plurality of protected zones with light by way of at least one of the condenser member or members;

light reflected from at least a portion of the protected zones being incident on at least one of the light-receiving element or elements by way of at least one of the condenser member or members;

at least a portion of the light-projecting element or elements and at least a portion of the light-receiving element or elements being disposed at one or more focus or foci of at least a portion of the condenser member or members;

wherein when at least one of the protected zones which is proximate to at least a portion of the light-projecting element or elements and/or at least a portion of the light-receiving element or elements is taken as reference, at least one edge, on at least one side toward at least a portion of the light-projecting element or elements and/or at least a portion of the light-receiving element or elements, of at least one of the protected zones which is located in at least one direction extending laterally from the at least one reference protected zone is formed so as to be more or less collinear with at least one edge, on at least one side toward at least a portion of the light-projecting element or elements and/or at least a portion of the light-receiving element or elements, of the at least one reference protected zone.

2. A sensor according to claim 1 wherein:

at least one of the condenser member or members is formed such that there are a plurality of condenser regions arrayed therein; and at least one of the condenser regions which is designed to irradiate at least a portion of the at least one reference protected zone serves as axis about which at least one of the condenser regions which is designed to irradiate at least a portion of at least one of the protected zones which is located in at least one direction extending laterally therefrom is disposed in inclined fashion.

3. A sensor according to claim 1 wherein:

at least one of the condenser member or members is formed such that there are a plurality of condenser regions arrayed therein; and at least a portion of the respective focal lengths from at least one of the light-projecting and/or light-receiving elements to the plurality of condenser regions are set such that at least one focal length therefrom to at least one of the condenser region or regions designed to irradiate at least a portion of the protected zone or zones located in the direction or directions extending laterally is greater than at least one focal length therefrom to at least one of the condenser region or regions designed to irradiate at least a portion of the reference protected zone or zones.

4. A sensor according to claim 2 wherein:

at least one of the condenser member or members is formed such that there are a plurality of lenses arrayed therein.

5. A sensor according to claim 2 wherein:

at least one of the condenser member or members is at least one prism, at least one lens being disposed at at least one side thereof toward at least one of the light-projecting and/or light-receiving elements.

6. A sensor according to claim 2 wherein:

at least one of the condenser member or members is formed such that there are a plurality of mirrors arrayed therein.

7. A sensor according to claim 3 wherein:

at least one of the condenser member or members is formed such that there are a plurality of lenses arrayed therein.

8. A sensor according to claim 3 wherein:

at least one of the condenser member or members is formed such that there are a plurality of mirrors arrayed therein.

* * * * *